US006487828B1

(12) United States Patent
Phillips

(10) Patent No.: US 6,487,828 B1
(45) Date of Patent: Dec. 3, 2002

(54) TABBED SHINGLES LENGTH CUT AT MID-TAB

(75) Inventor: John David Phillips, Pataskala, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/607,271

(22) Filed: Jun. 30, 2000

(51) Int. Cl.[7] ..... E04D 1/14

(52) U.S. Cl. ..... 52/554; 52/555; 52/557; 52/559; 52/314; 428/141; 428/142; 428/143

(58) Field of Search ..... 52/554, 555, 557, 52/559, 314, 311.2; 428/141, 142, 143, 194

(56) References Cited

U.S. PATENT DOCUMENTS

| | | | | |
|---|---|---|---|---|
| 1,295,360 A | | 2/1919 | Overbury | |
| RE15,280 E | * | 2/1922 | Abraham | 52/554 |
| 1,619,599 A | * | 3/1927 | Cumfer | 52/557 |
| 1,760,873 A | * | 6/1930 | Kirschbraun | 52/554 |
| 1,898,989 A | | 2/1933 | Harshberger | |
| 1,956,285 A | | 4/1934 | Harshberger | |
| 2,348,223 A | | 5/1944 | Papesh | |
| 3,919,823 A | | 11/1975 | Bradley | |
| 3,921,358 A | | 11/1975 | Bettoli | |
| 5,369,929 A | | 12/1994 | Weaver et al. | |
| 5,375,387 A | | 12/1994 | Davenport | |
| 5,426,902 A | | 6/1995 | Stahl et al. | |
| 5,611,186 A | | 3/1997 | Weaver | |
| 5,660,014 A | | 8/1997 | Stahl et al. | |
| 5,664,385 A | * | 9/1997 | Koschitzky | 52/559 |
| 5,666,776 A | | 9/1997 | Weaver et al. | |
| 5,853,858 A | | 12/1998 | Bondoc | |
| 5,961,780 A | * | 10/1999 | Kalkanoglu et al. | 156/517 |
| 6,010,589 A | | 1/2000 | Stahl et al. | |
| 6,014,847 A | | 1/2000 | Phillips | |
| 6,038,826 A | | 3/2000 | Stahl et al. | |
| 6,038,827 A | | 3/2000 | Sieling | |
| 6,212,843 B1 | * | 4/2001 | Kalkanoglu et al. | 52/555 |
| 6,361,851 B1 | * | 3/2002 | Sieling et al. | 428/144 |
| 2001/0000372 A1 | * | 4/2001 | Kalkanoglu et al. | 52/314 |

FOREIGN PATENT DOCUMENTS

| | | | | |
|---|---|---|---|---|
| CA | 179758 | * | 7/1917 | 52/559 |
| CA | 686819 | * | 5/1964 | 52/314 |
| CA | 997582 | * | 9/1976 | 52/314 |
| FR | 2417605 | * | 10/1979 | 52/314 |

* cited by examiner

*Primary Examiner*—Lanna Mai
*Assistant Examiner*—Phi Dieu Tran A
(74) *Attorney, Agent, or Firm*—Inger H. Eckert; James J. Dottavio

(57) ABSTRACT

A granule covered roofing shingle has a lower, tab portion, an upper, headlap portion, a first end and a second end, the shingle being suitable for installing on roof decks end-to-end with similar shingles in overlapping longitudinal courses, the tab portion having tabs and cutouts. The shingle has a fractional tab at each end of the shingle, and one or more whole tabs positioned between the ends of the shingle. The whole tabs and fractional tabs include a layer of granules to form a color blend, wherein both the fractional tabs of the shingle have the same color blend. When the shingle is installed on a roof deck with other substantially identically shaped shingles in overlapping longitudinal courses, adjacent shingles in the same course of shingles have fractional tabs that adjoin each other and that are of the same generally uniform color blend so that the two adjoining fractional tabs have the appearance of a single tab.

25 Claims, 5 Drawing Sheets

TABBED SHINGLES LENGTH CUT AT MID-TAB

TECHNICAL FIELD

This invention relates in general to a shingle, and in particular, to a roofing shingle having cutouts and tabs, and for a process of making such shingles. More particularly, this invention pertains to a tabbed shingle and a method of cutting such a shingle from a continuous granule covered shingle sheet in such a manner as to improve the efficiency of the cutting process and the visual appearance of the shingle on the roof

BACKGROUND OF THE INVENTION

In the past, roofing shingles have had to satisfy two main functions when applied to a roof deck. The first function is to provide a durable, weatherproof covering for the roof deck. Roof shingles, whatever their form, are intended to provide a means of sheltering the structure below the shingles from precipitation and the deleterious effects of sun and wind. Roof shingles installed on the roof deck must perform these protecting functions for a reasonable period of time. The second function is to present an aesthetically pleasing architectural feature which enhances the overall appeal of the structure to which the shingles have been applied. This aesthetic function has been satisfied by providing asphalt shingles with various butt edge contours and surface treatments which operate to simulate more traditional, and in most cases more expensive, forms of roof coverings, such as, thatch, wooden shakes, slates, and even tiles of various forms.

Natural slate tiles have long been used as a roof covering. Natural slate is a durable material and is considered to provide an aesthetically pleasing look or appearance to a roof. One of the features of roofs of natural slate is that different sources of slate have different colors, and the availability of any one color in any particular region of the country will determine its relative price with respect to slate of other colors available. Therefore, natural slate roofs tend to have a predominant color, such as gray, with one or more additional, more expensive accent colors interspersed to add variety. An example of a common mix of colors for a slate roof might include roughly 60 percent of the tiles having a light gray background color, about 15 percent of the tiles having a purple color, and about 25 percent of the tiles having a dark gray color.

A problem with natural slate roofs is that the installed cost is extremely high. Therefore, alternatives in the form of asphalt shingles and highly filled plastic resin tiles that mimic the look of natural slate have been developed. In the case. of asphalt is shingles mimicking the look of natural slate, each shingle is typically provided with relatively wide tabs, such as for example, 9 inches wide, separated by relatively narrow cutouts, such as 1 inch wide. When these shingles are cut, they are typically made with a half-cutout at each end so that when adjacent shingles are laid end-to-end on the roof a complete 1-inch cutout is formed.

The tabs of slate-look asphalt shingles are covered with colored granules to simulate slate tiles of different colors, with each tab having a generally uniform color to provide the visual impression that each tab is an individual natural slate tile. The shingles are typically laminated shingles, and the color of the underlay showing through the cutouts is usually darker than the tabs of the overlay to further enhance the appearance of thickness for the simulated tiles. To achieve this look or appearance, the shingle must be carefully manufactured with apparatus that enables each tab to be provided with a uniform colored appearance, with the color of each tab being either different or alike from each adjoining or neighboring tab, as dictated by the color pattern of the slate tiles that are being simulated.

The most aesthetically pleasing slate tile look requires the use of cutouts having a generally uniform width. This is not a problem for the complete cutouts cut by the cutting cylinder. However, where two shingles are laid end-to-end in a longitudinal course on the roof, there is difficulty assuring that the two half-cutouts of adjacent shingles will form a complete cutout that is sufficiently uniform in width with respect to the other cutouts (i.e., the whole cutouts formed by the cutting cylinder) for an aesthetically pleasing appearance on the roof. In order to produce perfectly formed half-cutouts very precise manufacturing control is required. It would be advantageous if there could be developed a shingle manufacturing operation that better accommodated the need for shingle cutouts having uniform widths.

SUMMARY OF THE INVENTION

The above objects as well as other objects not specifically enumerated are achieved by a granule covered roofing shingle having a lower, tab portion, an upper, headlap portion, a first end and a second end, the shingle being suitable for installing on roof decks end-to-end with similar shingles in overlapping longitudinal courses, the tab portion having tabs and cutouts. The shingle has a fractional tab at each end of the shingle, and one or more whole tabs positioned between the ends of the shingle. The whole tabs and fractional tabs include a layer of granules to form a color blend, wherein both the fractional tabs of the shingle have the same color blend. When the shingle is installed on a roof deck with other substantially identically shaped shingles in overlapping longitudinal courses, adjacent shingles in the same course of shingles have fractional tabs that adjoin each other and that are of the same generally uniform color blend so that the two adjoining fractional tabs have the appearance of a single tab.

According to this invention there is also provided a roof of the shingles of the invention.

According to this invention there is also provided a pair of granule covered roofing shingles, each shingle having a lower, tab portion, an upper, headlap portion, a first end and a second end, the shingles being suitable for installing on roof decks with the first end of the second shingle abutting the second end of the first shingle. The shingles are adapted for installation end-to-end with similar shingles in overlapping longitudinal courses. The tab portion of each shingle has tabs and cutouts, the shingles each having a fractional tab at each end of the shingle, and at least one whole tab positioned between the ends of each shingle. The whole tabs and the fractional tabs include a layer of granules to form color blends. The fractional tab at the first end of the second shingle and the fractional tab at the second end of the first shingle are of substantially the same generally uniform first color blend. At least one of the whole tabs of at least one of the shingles is of a second color blend different from the first color blend of the fractional tabs.

According to this invention there is also provided a roof of the shingles of the invention, wherein the shingles are installed on a roofing deck in overlapping courses, with the tabs of the shingles of a second course overlapping the headlap portion of the shingles of a lower, first course. Each of the tabs of the second course are positioned between two adjacent tabs of shingles on the first course. The tabs of the shingles of a third course overlap the headlap portion of the shingles of the second course. Each of the tabs of the second course are positioned between two adjacent tabs of shingles on the first course. The tabs of the second color blend on the second course are positioned between tabs of the first and third color blends on the first and third courses.

According to this invention there is also provided a process of making granule covered roofing shingles comprising coating a shingle mat to form an asphalt coated sheet, and applying granules to the asphalt coated sheet to form a granule covered sheet having distinct color portions of generally uniformly appearing color blends. cutouts are cut between the distinct portions to define tabs in the granule covered sheet, where each tab corresponds with one of the distinct color portions. The granule covered sheet is end cut to form individual shingles, where the end cuts are positioned within a tab so that each shingle has a fractional tab at each end of the shingle.

Various objects and advantages of this invention will become apparent to those skilled in the art from the following detailed description of the preferred embodiment, when read in light of the accompanying drawings.

DETAILED DESCRIPTION OF THE INVENTION

Figure 1:
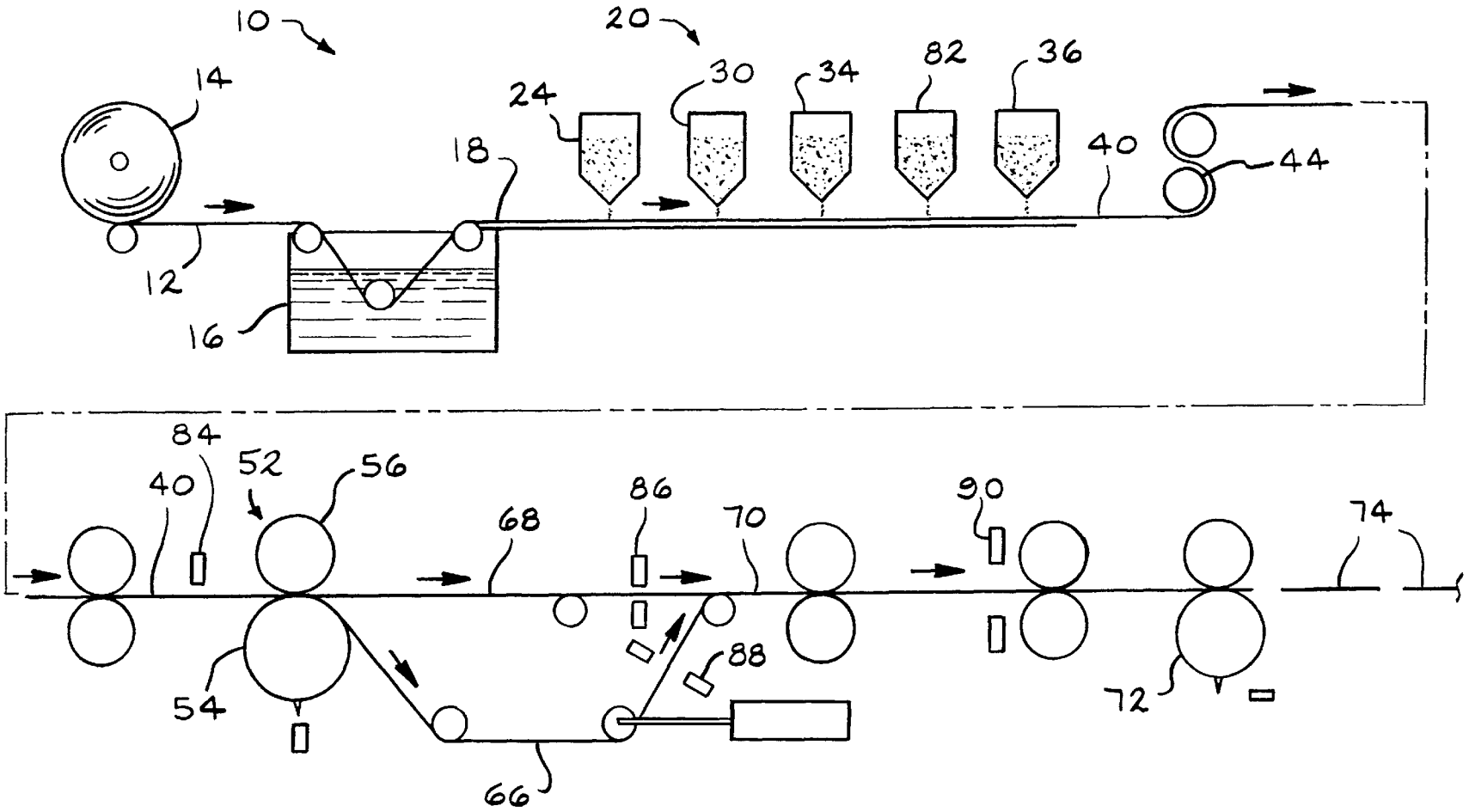
FIG. 1 is a schematic elevational view of an apparatus for making shingles according to the invention.
Figure 2:
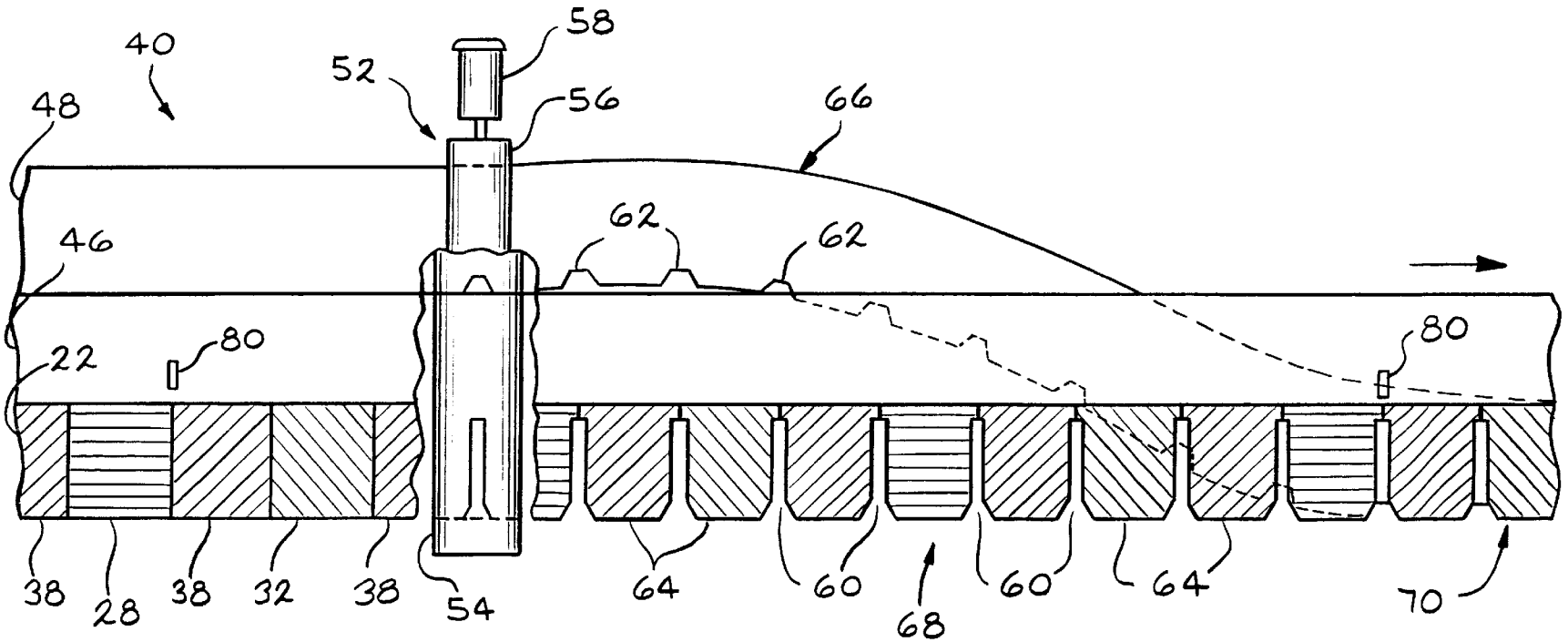
FIG. 2 is a plan view of a portion of the apparatus of FIG. 1, showing the laminating of shingle underlay beneath the overlay to make a laminated strip.

Referring now to the drawings, there is shown in FIGS. 1 and 2 an apparatus 10 for manufacturing an asphalt-based roofing material according to the invention. The illustrated manufacturing process involves passing a continuous sheet 12 in a machine direction (indicated by the arrows) through a series of manufacturing operations. The sheet usually moves at a speed of at least about 200 feet/minute (61 meters/minute), and typically at a speed within the range of between about 450 feet/minute (137 meters/minute) and about 800 feet/minute (244 meters/minute).

In a first step of the manufacturing process, a continuous sheet of substrate or shingle mat 12 is payed out from a roll 14. The substrate can be any type known for use in reinforcing asphalt-based roofing materials, such as a nonwoven web of glass fibers. The shingle mat 12 is fed through a coater 16 where an asphalt coating is applied to the sheet. The asphalt coating can be applied in any suitable manner. In the illustrated embodiment, the sheet is submerged in a supply of hot, melted asphalt coating to completely cover the sheet with the tacky coating. However, in other embodiments, the asphalt coating could be sprayed on, rolled on, or applied to the sheet by other means. Typically the asphalt material is highly filled with a ground stone filler material, amounting to at least about 60 percent by weight of the asphalt/filler combination.

The resulting asphalt coated sheet 18 is then passed beneath a series of granule dispensers 20 for the application of granules to the upper surface of the asphalt coated sheet. The granule dispensers can be of any type suitable for depositing granules onto the asphalt coated sheet. A preferred granule dispenser is a granule blender of the type disclosed in U.S. Pat. No. 5,599,581 to Burton et al., which is hereby incorporated by reference, in its entirety. The initial granule blender 24 deposits partial blend drops of background granules of a first color blend on the tab portion 22 of the asphalt coated sheet 18 in a pattern that sets or establishes the trailing edge of subsequent blend drops of a second color blend (of an accent color) and a third color blend (of a different accent color). For purposes of this patent application, the first color blend and the background granules are synonymous. The use of initially applied partial blend drops to define the trailing edge of subsequent blend drops is useful where accurate or sharp leading edges are possible, but accurate trailing edges at high shingle manufacturing speeds are difficult. This technique of using initially applied partial blend drops is disclosed in U.S. Pat. No. 5,405,647 to Grubka et al., which is hereby incorporated by reference, in its entirety.

As is well known in the art, blend drops applied to the asphalt coated sheet are often made up of granules of several different colors. For example, one particular blend drop that is supposed to simulate a weathered wood appearance might actually consist of some brown granules, some dark gray granules and some light gray granules. When these granules are mixed together and applied to the sheet in a generally uniformly mixed manner, the overall appearance of weathered wood is achieved. For this reason, the blend drops are referred to as having a color blend, which gives an overall color appearance, and this overall appearance may be different from any of the actual colors of the granules in the color blend. Also, blend drops of darker and lighter shades of the same color, such as, for example, dark gray and light gray, are referred to as different color blends rather than merely different shades of one color.

Figure 3:
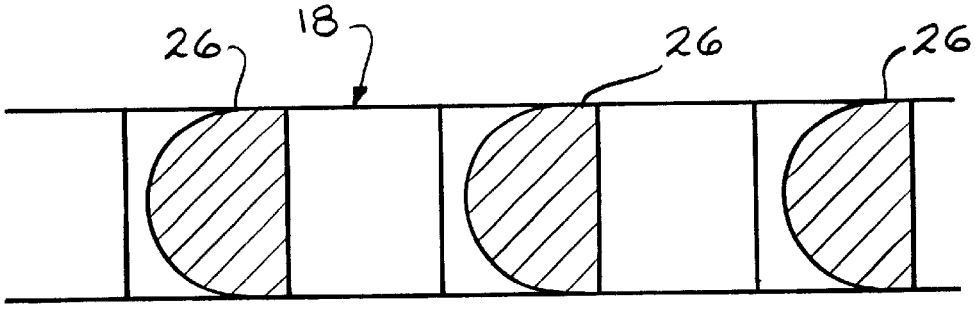
FIG. 3 is a schematic plan view of the tab portion of the asphalt coated sheet with some of the background granules applied in selected areas.
Figure 4:
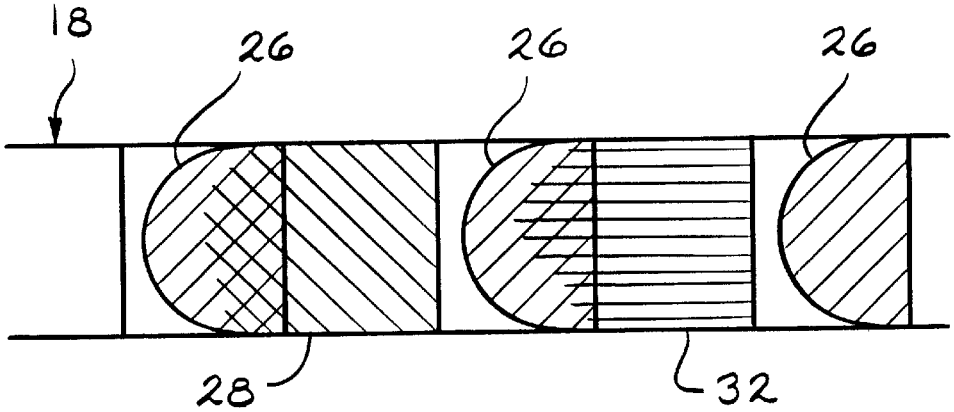
FIG. 4 is a view of the sheet of FIG. 3 with accent colored granules of a different color bled plied to the Applicants coated sheet.
Figure 5:
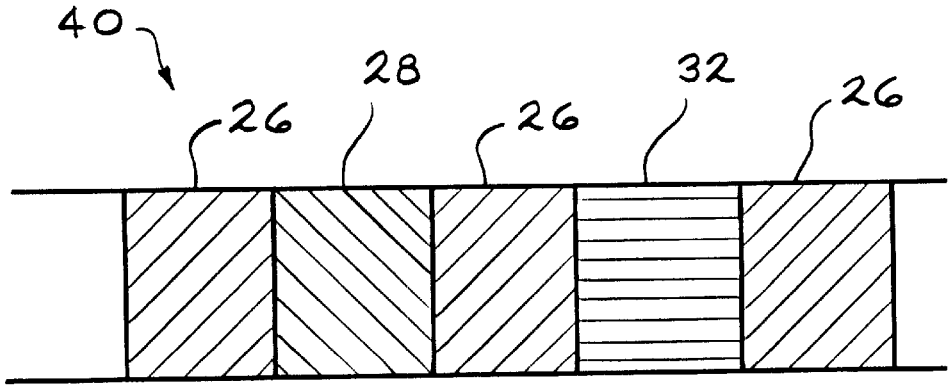
FIG. 5 is a view of the sheet of FIG. 4 with the remainder of the background granules applied.

The initially applied blend drops of background granules (or granules of a first color blend) from the initial granule blender 24 forms partial blend drops 26 on the tab portion of the asphalt coated sheet 18, as shown in FIG. 3. In a subsequent step, as shown in FIG. 4, the blend drop 28 for the second color blend is deposited from another granule blender, second color blend blender 30. It can be seen that the leading edge of the second color blend drop 28 is sharp, but that the trailing edge is fuzzy. However, since the partial blend drop 26 of the background granules has already been applied, the second color blend drop 28 will have a sharp trailing edge. Blend drop 32 of the third color blend is then dropped from the third color blend blender 34, as shown in FIGS. 1 and 4. This third color blend drop 32 has the desired sharp leading edge, and the trailing edge is defined by the already-applied partial blend drop 26. As a final granule application step, a fourth blender, which is the second background granule blender 36, applies background granules of the first color blend to the remaining uncovered portions of the asphalt coated sheet 18, thereby completing the background portions 38 of the sheet and forming a granule covered sheet 40, as shown in FIG. 5. It can be seen that the granule covered sheet has distinct color portions 28, 32 and 38 of generally uniformly appearing colored granules. As explained above, it is to be understood that a distinct color pattern or shade can be made of granules of a single color, or of a blend of granules of different colors which, when well mixed and applied to the asphalt coated sheet, present an appearance of a uniform single color.

It is to be understood that the individual different-colored or distinct granule portions or drops 28, 32 and 38 shown as being applied to the tab portion 22 of the granule covered sheet 40 in FIG. 5 will be further separated by the subsequent introduction of cutouts, as will be described below. An example of a color pattern that can be used involves selecting light gray granules as the background or first color blend color, supplied to the initial granule blender 24 and the second background granule blender 36. The second color blend can be dark gray, applied with the second color blend blender 30, and the third color blend can be red granules, applied to the sheet by the third color blend blender 34. It is to be understood that the headlap portion 46 of the asphalt coated sheet 18 and the underlay portion 48 of the asphalt coated sheet 18, both shown in FIG. 2, are also covered with granules in the manner well known in the art. Preferably, the granules on the underlay portion 48 are relatively dark in color.

After all the granules are deposited on the sheet, the granule covered sheet 40 is turned around a slate drum 44 to press the granules into the asphalt coating and to temporarily invert the sheet so that the excess granules will fall off and will be recovered and reused. The granule covered sheet 40 is subsequently fed through a rotary pattern cutter 52 which includes a bladed cutting cylinder 54, backup roll 56 and a motor 58, as shown in FIGS. 1 and 2. The pattern cutter 52 cuts a series of cutouts 60 in the tab portion 22 of the granule covered sheet 40, and also cuts a series of notches 62 in the underlay portion 48 of the granule covered sheet. It can be seen that the cutouts 60 divide the various color blend drops 28, 32, 38 into tabs 64, with each tab being one of the three colors of the blend drops, i.e., the background color or first color blend, the second color blend or the third color blend.

The pattern cutter 52 also cuts the granule covered sheet 40 into the continuous underlay sheet 66 and the continuous overlay sheet 68. As shown in FIG. 2, the underlay sheet is directed to be aligned beneath the overlay sheet, and the two sheets are laminated together to form a continuous laminated sheet 70. As shown in FIG. 1, the continuous underlay sheet 66 is routed on a longer path than the path of the continuous overlay sheet 68. Further downstream the continuous laminated sheet 70 is passed into contact with a rotary length cutter 72 that cuts the laminated sheet into individual laminated shingles 74.

In order to facilitate synchronization of the cutting and laminating steps, various sensors and controls can be employed. A timing mark 80 indicating the period of the blend drops 28, 32, 38 can be applied to an appropriate part of the shingle, such as the headlap portion 46, to be used for synchronization. The timing mark can be applied by any means, and can be a thin blend drop of granules applied by the timing mark blender 82. The timing can be sensed by a sensor, such as a photoeye 84, for synchronization with the rotating rotary pattern cutter 52 so that the cutouts 60 and notches 62 will be situated at the intersections of adjacent blend drops. Sensors, such as photoeyes 86 and 88 can be used to synchronize the continuous underlay sheet 66 with the continuous overlay sheet 68. Sensors 90 can be used to synchronize the notches and cutouts of the continuous laminated sheet with the end cutter or length cutter 72.

Figure 6:
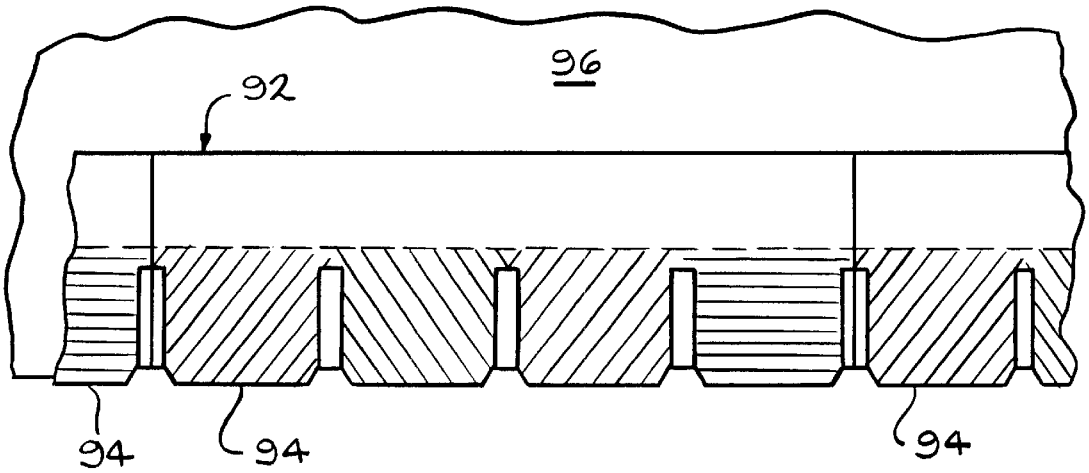
FIG. 6 is a plan view of a course of conventionally end cut shingles laid end-to-end on a roof deck.

The length cutting or end cutting of the continuous laminated sheet 70 into laminated slate-look shingles, when carried out in a conventional manner, results in length cutting the shingle right through the middle of the cutout. This is illustrated in the longitudinal course 92 of conventionally cut shingles 94 installed on roof deck 96, as shown in FIG. 6. As described above, length cutting within the cutout poses some problems because even slight inaccuracies or variations in the end cutting will show up when the shingles are laid end-to-end on the roof.

Figure 7:
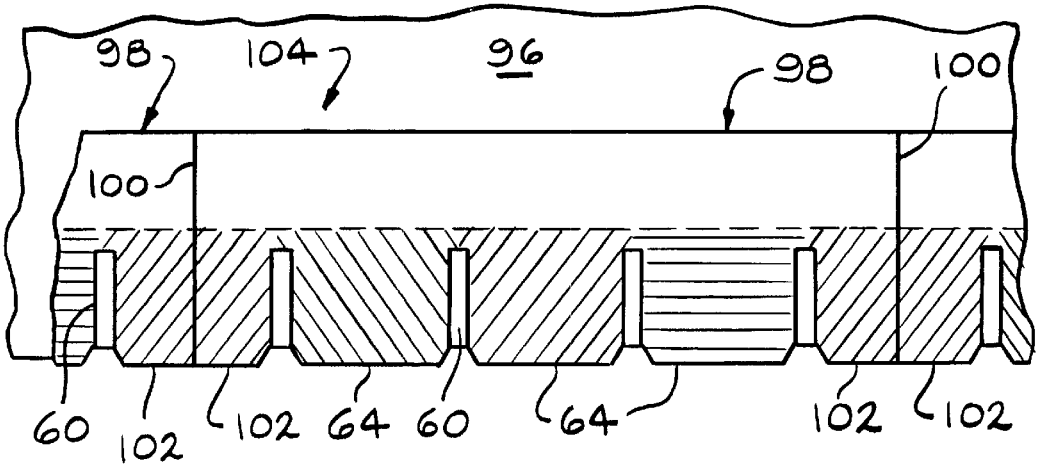
FIG. 7 is a plan view of a course of shingles of the invention installed end-to-end on a roof decks.

In contrast to the conventionally cut shingles shown in FIG. 6, the shingles 98 of the invention shown in FIG. 7 have been end cut in the tab portion 64 of the shingle rather than in the cutout 60. Preferably, the end cut is made at the approximate center of the tab so that the fractional tabs have a width of approximately ½ the width of the whole tabs. At each end 100 of the shingle is a partial or fractional tab 102, and when the shingles 98 are laid end-to-end as a longitudinal course of shingles 104 on the roof deck 96, the two fractional tabs 102 combine to make a full tab 64. By providing the end cutting of the shingle at a mid-tab position, the inaccuracies or variations in the synchronization of the continuous laminated sheet 70 and the rotary length cutter 72 are not as pronounced in appearance on the roof as when the end cuts are made within the cutout area of the shingle. When the end cuts are within the cutouts 60, the typically permissible error tolerance requires an accuracy within about 1/16 inch. However, when the end cuts are made within the tabs 64, the permissible error tolerance requires an accuracy within about ⅛ inch. This greater error tolerance enables the manufacturing process to be carried out more efficiently, thereby lowering manufacturing costs. As can be seen in FIG. 7, the shingle comprises three whole tabs between the fractional tabs of each shingle, wherein the first whole tab adjacent the fractional tab at the first end of the second shingle is of the second color blend, the second whole tab being substantially of the first color blend, and the third whole tab being of a third color blend, different from the first and second color blends. Also, it can be seen that the underlay of the laminated shingle 98 is visible in the cutouts 60 between the tabs. Preferably, the underlay is of a fourth color blend that is darker than the first, second and third color blends.

Figure 8:
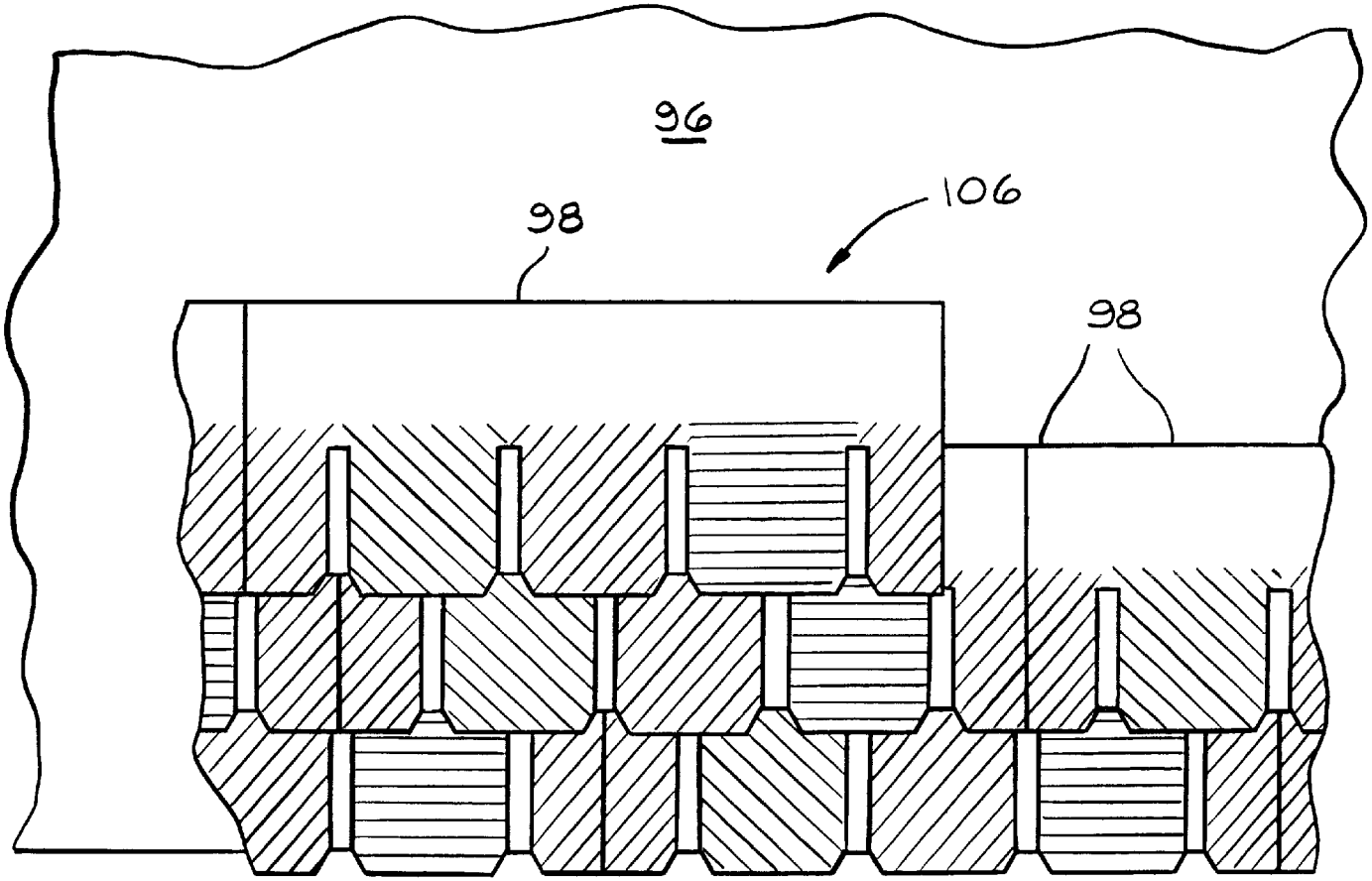
FIG. 8 is a plan view of several courses of shingles of the invention installed on a roof deck.

The resulting shingle 98 of the invention has whole tabs that are all of the same approximate width, and preferably fractional tabs having a width of approximately one-half the width of the whole tabs. In order to maintain the desired aesthetic appearance of the shingles 98 of the invention, both of the fractional tabs 102 of each shingle 98 must be of the same color appearance, such as, for example, the background color of background portions 38. With each fractional tab 102 being of the same color appearance, end-to-end placement of substantially identically shaped shingles in the form of a roof covering 106 of overlapping longitudinal courses, as shown in FIG. 8, can be readily accomplished. To provide the best color contrast, it is preferred that for some of the shingles 98 of the invention the whole tabs that are positioned immediately next to the fractional tabs have a color blend that is different from the color blend of the fractional tabs. However, it is to be understood that for the shingles of the invention to provide the optimal appearance of a natural slate roof, there may be repeated (i.e., adjacent) tabs of the background color of background portions 38. In a preferred embodiment of the invention, at least about 60 percent of the tabs are of the first color blend, with the remainder being of other color blends. Although fractional tabs 102 that are approximately one-half of the width of the tabs 64 are preferred, it is to be understood that the end cutting can cut the tab in a manner that produces a longer fractional shingle tab at one end of the shingle and a shorter fractional shingle tab at the other end of the shingle.

It can be seen from FIG. 8 that the shingles are installed on a roofing deck in overlapping courses. The tabs of the shingles of the second course are overlapping the headlap portion of the shingles of a lower, first course. Each of the tabs of the second course are positioned between two adjacent tabs of shingles on the first course. The tabs of the shingles of a third course overlap the headlap portion of the shingles of the second course. Each of the tabs of the second course are positioned between two adjacent tabs of shingles on the first course. In a specific embodiment of the invention, the tabs of the second color blend on the second course are positioned between tabs of the first and third color blends on the first and third courses.

Further, if a fourth course were to be added, the tabs of the fourth course would overlap the headlap portion of the shingles of the third course, with each of the tabs of the fourth course being positioned between two adjacent tabs of shingles on the third course. In another specific embodiment of the invention, the tabs of the second color blend on the third course would be positioned between tabs of the first and third color blends on the second and fourth courses.

A highly preferred width and spacing of the tabs and cutouts is about 9 inches and about 1 inch, respectively. Other spacing is possible. Preferably, the width of the tabs is within range of from about 5 to about 12 inches, and the width of the cutouts is within the range of from about ½ to about 3 inches. Also, although at least one whole tab is required, in a preferred embodiment of the invention there are three whole tabs and two fractional tabs in each shingle.

It is to be understood that the invention can be practiced by scaling up the single-wide shingle apparatus shown in the drawings (FIGS. 1 and 2) to a two-wide, three-wide or four-wide shingle apparatus, not shown. In such a case the invention would involve simultaneously making two, three, or four shingles, respectively rather than one shingle at the same time.

The principle and mode of operation of this invention have been described in its s preferred embodiments. However, it should be noted that this invention may be practiced otherwise than as specifically illustrated and described without departing from its scope.

What is claimed is:

1. A granule covered roofing shingle having a lower, tab portion, an upper, headlap portion, a first end and a second end, the shingle being suitable for installing on roof decks end-to-end with similar shingles in overlapping longitudinal courses, the tab portion having tabs and cutouts, the shingle having a fractional tab at each end of the shingle, and one or more whole tabs positioned between the ends of the shingle, where the whole tabs and fractional tabs include a layer of granules to form a color blend, wherein both the fractional tabs of the shingle have the same color blend, and wherein when the shingle is installed on a roof deck with other substantially identically shaped shingles in overlapping longitudinal courses, adjacent shingles in the same course of shingles have fractional tabs that adjoin each other and that are of the same generally uniform color blend so that the two adjoining fractional tabs have the appearance of a single tab, and wherein at least one of the whole tabs has a color blend that is different from the color blend of the fractional tabs.

2. The shingle of claim 1 in which the whole tabs that are positioned immediately next to each of the fractional tabs have a color blend that is different from the color blend of the fractional tabs.

3. The shingle of claim 1 in which the whole tabs are all of the same approximate width.

4. The shingle of claim 3 in which the tabs are evenly spaced apart by the cutouts.

5. The shingle of claim 3 in which the fractional tabs have a width of approximately ½ the width of the whole tabs.

6. The shingle of claim 3 having a longer fractional shingle tab at one end of the shingle and a shorter fractional shingle tab at the other end of the shingle.

7. The shingle of claim 1 in which the shingle is a laminated shingle having an underlay member attached to an overlay member.

8. The shingle of claim 1 in which the width of the tabs is within range of from about 5 to about 12 inches, and width of the cutouts is within the range of from about ½ to about 3 inches.

9. A roof of shingles according to claim 1.

10. A roof according to claim 9, wherein at least about 60% of the tabs are of the first color blend, with the remainder being of other color blends.

11. The shingle of claim 1 in which the at least one whole tab that has a color blend that is different from the color blend of the fractional tabs is positioned immediately next to one of the fractional tabs.

12. The shingle of claim 1 in which each whole tab is comprised of a generally uniform color blend.

13. A pair of granule covered roofing shingles, each shingle having a lower, tab portion, an upper, headlap portion, a first end and a second end, the shingles being suitable for installing on roof decks with the first end of the second shingle abutting the second end of the first shingle, the shingles being adapted for installation end-to-end with similar shingles in overlapping longitudinal courses, the tab portion of each shingle having tabs and cutouts, the shingles each having a fractional tab at each end of the shingle, and at least one whole tab positioned between the ends of each shingle, where the whole tabs and the fractional tabs include a layer of granules to form color blends, the fractional tab at the first end of the second shingle and the fractional tab at the second end of the first shingle being of substantially the same generally uniform first color blend, and at least one of the whole tabs of at least one of the shingles being of a second color blend different from the first color blend of the fractional tabs.

14. The shingles of claim 13 further each comprising three whole tabs between the fractional tabs of each shingle, wherein the first whole tab adjacent the fractional tab at the first end of the second shingle is of the second color blend, the second whole tab being substantially of the first color blend, and the third whole tab being of a third color blend, different from the first and second colors blends.

15. The shingles of claim 14, wherein each shingle comprises a laminated shingle having an underlay visible in the cutouts between the tabs, the underlay being of a fourth color blend, the fourth color blend being darker than the first, second and third color blends.

16. A roof of shingles according to claim 13, wherein the shingles are installed on a roofing deck in overlapping courses, the tabs of the shingles of a second course overlapping the headlap portion of the shingles of a lower, first course, each of the tabs of the second course being positioned between two adjacent tabs of shingles on the first course;

the tabs of the shingles of a third course overlapping the headlap portion of the shingles of the second course, each of the tabs of the second course being positioned between two adjacent tabs of shingles on the first course; and wherein tabs of the second color blend on the second course are positioned between tabs of the first and third color blends on the first and third courses.

17. A roof according to claim 16, further comprising a fourth course of shingles, the tabs of the fourth course overlapping the headlap portion of the shingles of the third course, each of the tabs of the fourth course being positioned between two adjacent tabs of shingles on the third course; and wherein tabs of the second color blend on the third course are positioned between tabs of the first and third color blends on the second and fourth courses.

18. A roof made with multiple applications of the shingles of claim 13.

19. A roof according to claim 18, wherein at least about 60% of the tabs are of the first color blend, with the remainder being of other color blends.

20. The shingle of claim 13 in which each whole tab is comprised of a generally uniform color blend.

21. A process of making granule covered roofing shingles comprising:

coating a shingle mat to form an asphalt coated sheet;

applying granules to the asphalt coated sheet to form a granule covered sheet having distinct color portions of generally uniformly appearing color blends;

cutting cutouts between the distinct portions to define tabs in the granule covered sheet, where each tab corresponds with one of the distinct color portions; and end cutting the granule covered sheet to form individual shingles, where the end cuts are positioned within a tab so that each shingle has a fractional tab at each end of the shingle;

wherein the step of applying granules involves applying granules in a pattern with the result that the fractional tabs at each end of the shingle are of the same general color blend; and wherein at least one of the whole tabs has a color blend that is different from the color blend of the fractional tabs.

22. The process of claim 21 in wherein the step of end cutting involves cutting the granule covered sheet so that the fractional tabs have a width of approximately ½ the width of the whole tabs.

23. The process of claim 21 wherein the step of applying granules involves applying granules in a pattern and cutting the cutouts in a manner resulting in having the tabs evenly spaced apart by the cutouts.

24. The process of claim 23 in which granules are applied to the asphalt coated sheet and the cutouts are cut in a manner resulting in tab widths within range of from about 5 to about 12 inches, and cutout widths within the range of from about ½ to about 3 inches.

25. The shingle of claim 21 in which each whole tab is comprised of a generally uniform color blend.

* * * * *